US010612347B2

(12) United States Patent
Deolalikar et al.

(10) Patent No.: US 10,612,347 B2
(45) Date of Patent: Apr. 7, 2020

(54) TURBINE-GENERATOR-ACTUATOR ASSEMBLY FOR ROTARY STEERABLE TOOL USING A GEARBOX

(71) Applicant: Halliburton Energy Services, Inc., Houston, TX (US)

(72) Inventors: Neelesh V. Deolalikar, Houston, TX (US); Daniel Winslow, Spring, TX (US); Benjamin S. Riley, Houston, TX (US); Mukul Agnihotri, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/552,679

(22) PCT Filed: Apr. 15, 2015

(86) PCT No.: PCT/US2015/025992

§ 371 (c)(1),
(2) Date: Aug. 22, 2017

(87) PCT Pub. No.: WO2016/167765

PCT Pub. Date: Oct. 20, 2016

(65) Prior Publication Data

US 2018/0038203 A1 Feb. 8, 2018

(51) Int. Cl.
*E21B 41/00* (2006.01)
*E21B 4/02* (2006.01)
(Continued)

(52) U.S. Cl.
CPC ..... *E21B 41/0085* (2013.01); *E21B 4/02* (2013.01); *E21B 21/103* (2013.01); *E21B 44/005* (2013.01);
(Continued)

(58) Field of Classification Search
CPC ..... E21B 41/0085; E21B 4/02; E21B 47/00; E21B 21/103; E21B 44/005; E21B 47/024; E21B 47/12; F05B 2220/706; F03B 13/02
See application file for complete search history.

(56) References Cited

U.S. PATENT DOCUMENTS 8,602,127 B2 * 12/2013 Hummes ..... E21B 4/02 175/106
2004/0104051 A1 6/2004 Moriarty et al.
(Continued)

FOREIGN PATENT DOCUMENTS

WO WO-2013191688 A1 * 12/2013 ..... E21B 41/0085
WO WO 2014/140661 A1 9/2014

OTHER PUBLICATIONS

International Search Report and the Written Opinion of the International Search Authority, or the Declaration, dated Jan. 15, 2016, PCT/US2015/025992, 15 pages, ISA/KR.

*Primary Examiner* — Michael R Wills, III

(57) ABSTRACT

Systems and methods of down-hole power generation are disclosed, which provide for the generation of electrical power in a down-hole environment for use by down-hole tools such as logging tools, telemetry, and electric control circuit. The electrical generator is operably coupled to a turbine shaft of a hydraulic turbine, and operates at a first rotational speed in response to a rotation of the turbine shaft. The turbine shaft is also coupled to a down-hole actuator such as a rotary drill bit such that the actuator operates at a second rotational speed in response to the rotation of the turbine shaft. A gearbox is operably coupled between the actuator and the turbine shaft to permit operation of the generator and actuator at different rotational speeds by the rotation of the turbines shaft.

19 Claims, 5 Drawing Sheets

(51) Int. Cl.

| | |
|---|---|
| *E21B 21/10* | (2006.01) |
| *E21B 44/00* | (2006.01) |
| *E21B 47/024* | (2006.01) |
| *E21B 47/12* | (2012.01) |
| *F03B 13/02* | (2006.01) |

(52) U.S. Cl.
CPC ..... *E21B 47/024* (2013.01); *E21B 47/12* (2013.01); *F03B 13/02* (2013.01); *F05B 2220/706* (2013.01)

(56) References Cited

U.S. PATENT DOCUMENTS

| | | | | |
|---|---|---|---|---|
| 2007/0125578 | A1 | 6/2007 | McDonald et al. | |
| 2009/0057016 | A1 | 3/2009 | Hall et al. | |
| 2010/0243265 | A1* | 9/2010 | Sherrill ..... | E21B 41/0085 166/373 |
| 2014/0069724 | A1* | 3/2014 | Amsellem ..... | E21B 4/02 175/57 |
| 2015/0083496 | A1 | 3/2015 | Winslow | |
| 2016/0017693 | A1* | 1/2016 | Winslow ..... | E21B 41/0085 175/95 |

* cited by examiner

TURBINE-GENERATOR-ACTUATOR ASSEMBLY FOR ROTARY STEERABLE TOOL USING A GEARBOX

PRIORITY

The present application is a U.S. National Stage patent application of International Patent Application No. PCT/US2015/025992, filed on Apr. 15, 2015, the benefit of which is claimed and the disclosure of which is incorporated herein by reference in its entirety.

BACKGROUND

1. Field of the Invention

The present disclosure relates generally to down-hole operations related to oil and gas exploration, drilling and production. More particularly, embodiments of the disclosure relate to systems and methods that employ hydraulic fluid flow through a turbine for down-hole electrical power generation and tool activation.

2. Background

Modern hydrocarbon drilling and production operations often require electrical power for equipment down-hole. For example, electrical power may be used down-hole for a number of applications, including well logging, formation evaluation, and telemetry. Both wellbore logging and formation evaluation tools often include active sensors that use power to obtain information. This information typically includes various characteristics and parameters of geologic formations traversed by the wellbore, data relating to the size and configuration of the wellbore itself, pressures and temperatures of ambient down-hole fluids, and other down-hole parameters. Telemetry equipment commonly utilizes electrical power to relay data acquired from various logging sensors or other tools to the surface.

One approach to generating electrical power down-hole utilizes the circulation of drilling fluid (or "mud") through a turbine to generate mechanical rotary motion in a turbine shaft, spinning a down-hole generator. Often, the turbine is constrained within a predefined speed range to prevent the generator from rotating too fast and thereby producing an overvoltage that may damage electronic equipment and to prevent the generator from operating too slowly to produce sufficient electrical power for the connected electronics. Often, the rotary motion in the turbine shaft is also employed to operate an actuator of another down-hole tool such as a hydraulic pump, a cutting tool, a vibratory tool, a valve mechanism or similar tool. At least one problem with this approach is that the actuator of these tools may have speed limitations that frustrate the efficiency of the generator.

BRIEF DESCRIPTION OF THE DRAWINGS

The disclosure is described in detail hereinafter on the basis of embodiments represented in the accompanying figures, in which.

DETAILED DESCRIPTION

Figure 1:
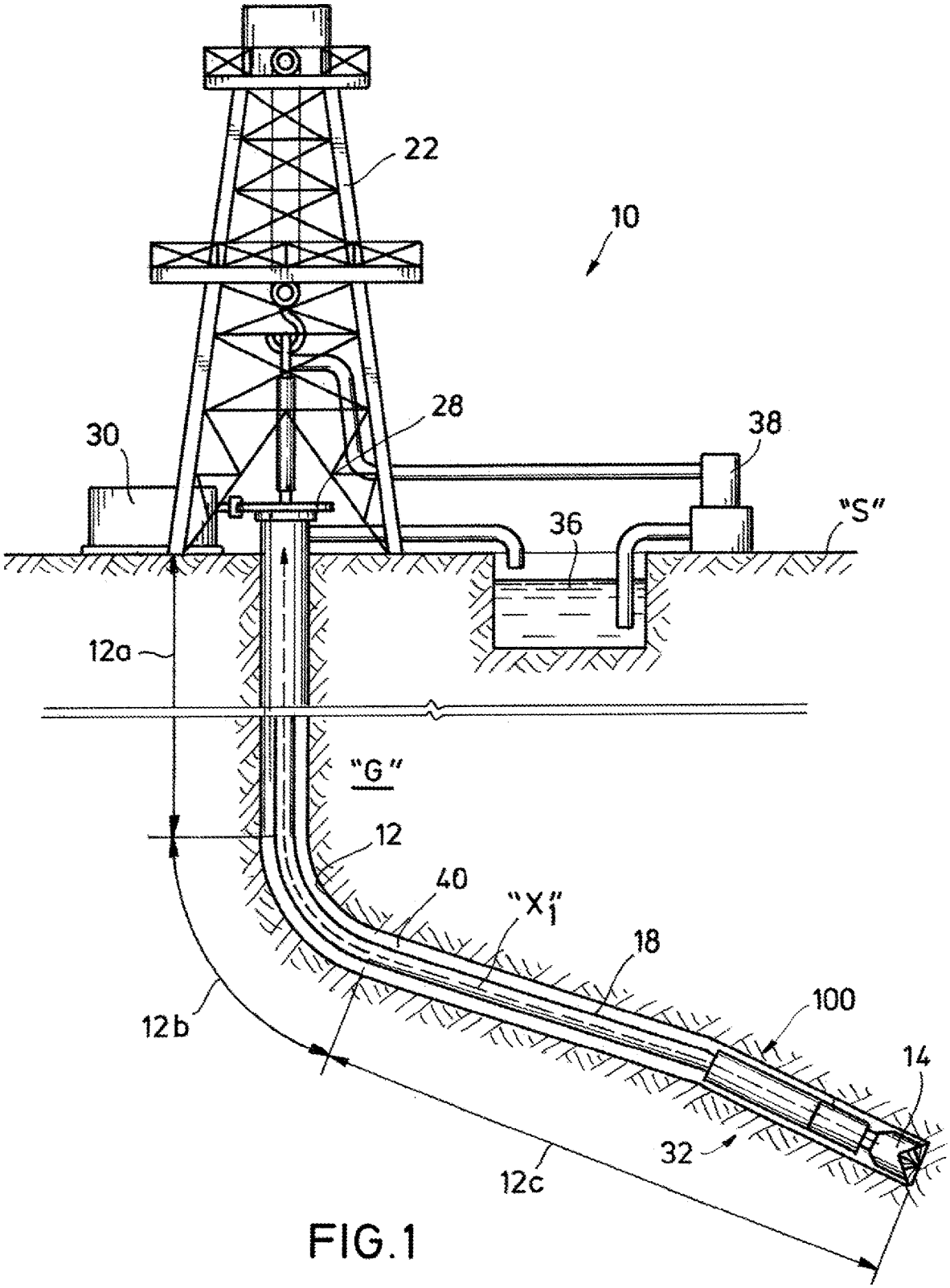
FIG. 1 is a cross-sectional schematic side-view of a drilling system including a down-hole power generation system in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, down-hole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the down-hole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a wellbore in a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depicts an offshore operation, it should be understood by those skilled in the art that the apparatus according to the present disclosure is equally well suited for use in onshore operations. Further, unless otherwise noted, even though a Figure may depict a cased hole, it should be understood by those skilled in the art that the apparatus according to the present disclosure is equally well suited for use in open-hole operations.

1. Description of Exemplary Embodiments

Referring to FIG. 1, a directional drilling system 10 is illustrated that includes a down-hole power generation system 100, in accordance with one or more embodiments of the present disclosure. Although directional drilling system 10 is illustrated in the context of a terrestrial drilling operation, it will be appreciated by those skilled in the art that aspects of the disclosure may be also practiced in connection with offshore platforms and or other types of hydrocarbon exploration and recovery systems as well.

Directional drilling system 10 is partially disposed within a directional wellbore 12 traversing a geologic formation "G." The directional wellbore 12 extends from a surface location "S" along a curved longitudinal axis $X_1$ to define a vertical section 12*a*, a build section 12*b* and a tangent section 12*c*. The tangent section 12*c* is the deepest section of the wellbore 12, and generally exhibits lower build rates (changes in the inclination of the wellbore 12) than the build section 12*b*. In some exemplary embodiments (not shown), the tangent section 12*c* is generally horizontal. Additionally, in one or more other exemplary embodiments, the wellbore 12 includes a wide variety of vertical, directional, deviated, slanted and/or horizontal portions therein, and may extend along any trajectory through the geologic formation "G."

A rotary drill bit 14 is provided at a down-hole location in the wellbore 12 (illustrated in the tangent section 12*c*) for cutting into the geologic formation "G." When rotated, the drill bit 14 operates to break up and generally disintegrate the geological formation "G." At the surface location "S" a drilling rig 22 is provided to facilitate rotation of the drill bit 14 and drilling of the wellbore 12. The drilling rig 22 includes a turntable 28 that generally rotates the drill string 18 and the drill bit 14 together about the longitudinal axis $X_1$. The turntable 28 is selectively driven by an engine 30, chain drive system, or other apparatus. Rotation of the drill string 18 and the drill bit 14 together may generally be referred to as drilling in a "rotating mode," which maintains the directional heading of the rotary drill bit 14 and serves to produce a straight section of the wellbore 12. e.g., vertical section 12*a* and tangent section 12*c*.

In contrast, a "sliding mode" may be employed to change the direction of the rotary drill bit 14 and thereby produce a curved section of the wellbore 12, e.g., build section 12*b*. To operate in sliding mode, the turn table 28 may be locked such that the drill string 18 does not rotate about the longitudinal axis $X_1$, and the rotary drill bit 14 may be rotated with respect to the drill string 18. To facilitate rotation of the rotary drill bit 14 with respect to the drill string 18, a bottom hole assembly or BHA 32 is provided in the drill string 18 at a down-hole location in the wellbore 12. The BHA 32 may include a down-hole motor that generates torque in response to the circulation of a drilling fluid, such as mud 36, therethrough. The BHA 32 may include a bent sub or housing (not explicitly identified) therein which defines the direction of drilling.

The terms "rotating mode" and "sliding mode" are generally associated with drilling systems employing a mud motor and a bent housing. As one skilled in the art will appreciate, aspects of the disclosure may be practiced with other types of drilling systems as well. For example, in some exemplary embodiments, the BHA 32 may include a rotary steerable mechanism (not explicitly identified), or other type of system in which the drill string 18 may be rotated while drilling both straight and/or curved sections of the wellbore 12.

The mud 36 can be pumped down-hole by mud pump 38 through an interior of the drill string 18. The mud 36 passes through the down-hole motor of the BHA 32 where energy is extracted from the mud 36 to turn the rotary drill bit 14. As the mud 36 passes through the BHA 32, the mud 36 may lubricate bearings (not explicitly shown) defined therein before being expelled through nozzles (not explicitly shown) defined in the rotary drill bit 14. The mud 36 lubricates the rotary drill bit 14 and flushes geologic cuttings and/or other debris from the path of the rotary drill bit 14. The mud 36 is then returned through an annulus 40 defined between the drill string 18 and the geologic formation "G." The geologic cuttings and other debris are carried by the mud 36 to the surface location "S" where the cuttings and debris can be removed from the mud stream.

As described in greater detail below, the down-hole power generation system 100 may be included in one or more components of the BHA 32 or may include one or more components of the BHA 32 therein. For example, the down-hole power generation system 100 may include a turbine 46 (FIG. 2) that is operably coupled to the rotary drill bit 14, or the turbine 46 may be operably uncoupled from the rotary drill bit 14.

Figure 2:
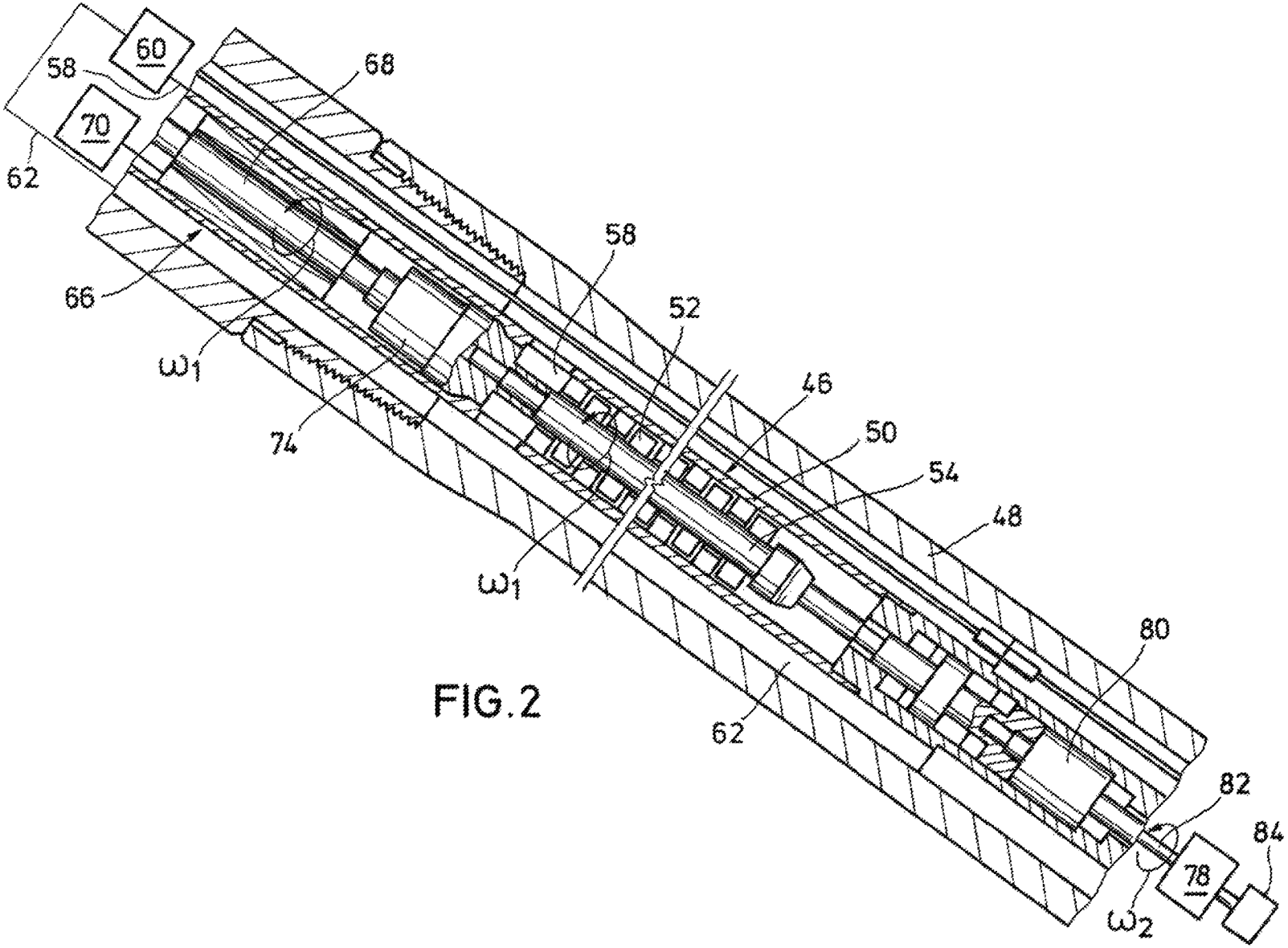
FIG. 2 is a cross-sectional schematic top-view of the down-hole power generation system of FIG. 1 illustrating a turbine operably coupled to an electrical generator and an accessory device.

Referring now to FIG. 2, down-hole power generation system 100 includes a turbine 46 disposed within an outer housing 48. The turbine 46 includes a stator 50, which is mounted in a stationary manner with respect to the outer housing 48. A rotor 52 is rotationally supported within the stator 50 and includes a turbine shaft 54. The stator 50 and the rotor 52 are shaped such that movement of the mud 36 (FIG. 1) through a central flow passage 58 induces rotation of the rotor 52 with respect to the stator 50. The rotor 52 extracts hydraulic energy from the circulation of the mud 36 (FIG. 1) through the turbine 46, and converts the hydraulic energy into mechanical rotational movement of the turbine shaft 54. The turbine 46 may include any mechanism responsive to the circulation of a fluid therethrough to generate rotational motion in a shaft thereof. In some exemplary embodiments, the turbine 46 can be a mud-motor mechanism, and in some exemplary embodiments, the turbine 46 can be a positive-displacement motor, sometimes referred to as a Moineau-type motor.

In some exemplary embodiments, a fluid control mechanism such as shear valve 60 is disposed at an up-hole location with respect to the turbine 46. The shear valve 60 is fluidly coupled to the turbine 46 and is operable to regulate the flow of mud 36 (FIG. 1) through the central flow passage 58 to thereby control a rotational speed $\omega_1$ of the turbine shaft 54. The shear valve may be selectively operable, e.g., to divert a portion of the mud 36 into a bypass passage 62 extending around the turbine 46. As one skilled in the art will appreciate, diverting a relatively large portion of the mud 36 through the bypass passage 62 causes the turbine shaft 54 to turn at a relatively low rotational speed $\omega_1$ and diverting a relatively small portion of the mud 36 through the bypass passage 62 causes the turbine shaft 54 to turn at a relatively high rotational speed $\omega_1$.

The turbine 46 is operably coupled to a generator 66 such that rotational movement of the turbine shaft 54 may be transmitted to a generator shaft 68. Rotation of the generator shaft 68 produces an electric voltage that can be used to power down-hole electronics 70 such as sensors, measure while drilling (MWD) tools, telemetry units, microprocessors, steering mechanisms, and/or other down-hole tools. In some exemplary embodiments, turbine shaft 46 may be mechanically coupled to the generator shaft 68 through a substantially rigid shaft coupler 74 that transmits the rotational speed $\omega_1$ of the turbine shaft 54 directly to the generator shaft 68. The generator shaft 68 may thus be induced to turn at the same rotational speed $\omega_1$ of the turbine shaft 54.

The turbine 46 is also operably coupled to an actuator 78 through a gearbox 80. The gearbox 80 is arranged to transfer torque from the turbine shaft 54 to an actuator shaft 82 such that the actuator shaft 82 rotates at a rotational speed $\omega_2$ that is different from the rotational speed $\omega_1$ of the turbine shaft 54. In some exemplary embodiments, the gearbox 80 includes planetary gear system in which a planet gear (not shown) is arranged to rotate around the center of a sun gear (not shown). The gearbox 80 permits the actuator 78 to provide rotational motion to a down-hole tool 84 that may have speed requirements or optimal operating ranges that are independent from the generator 66. In some exemplary embodiments the down-hole tool 84 may include a hydraulic pump, an off-center vibratory tool cutting tool, a valve mechanism, or other accessory mechanisms recognized in the art. In some exemplary embodiments, the down-hole tool 84 may include the rotary drill bit 14 (FIG. 1).

Figure 3:
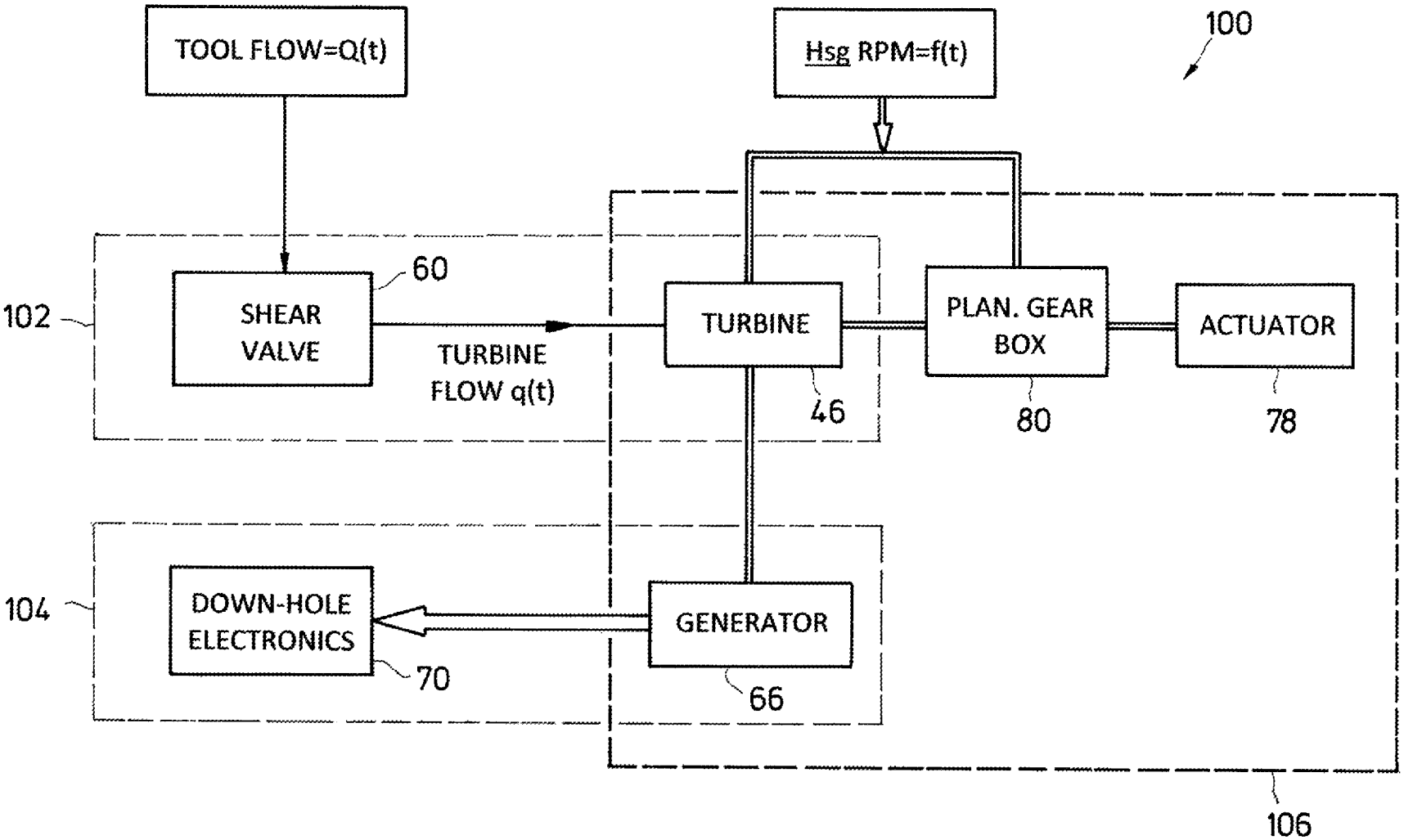
FIG. 3 is a schematic block diagram of a down-hole power generation system in accordance with some exemplary embodiments of the disclosure.

Referring to FIG. 3, the down-hole power generation system 100 may include a hydraulic circuit 102, an electrical circuit 104, and a mechanical circuit 106. The hydraulic circuit 102 generally includes the shear valve 60 and turbine 46 fluidly coupled to one another. The hydraulic circuit 102 generally receives a tool flow Q(t) of mud 36 (FIG. 1) or another fluid as an input. The tool flow Q(t) may be provided to the shear valve 60 where an appropriate portion of the mud 36 is directed to the turbine 46 to define a turbine flow q(t). The turbine flow q(t) operates to drive the turbine 46. The electrical circuit 104 generally includes the generator 66 and the down-hole electronics 70 electrically coupled thereto and powered thereby. The mechanical circuit 106 generally includes the turbine 46 and the components mechanically coupled thereto, including the generator 66, the gear box 80, and the actuator 78. Internal forces within the mechanical circuit 106 that influence the rotational speeds, e.g., speeds $\omega_1$ and $\omega_2$ (FIG. 2), of the components of the mechanical circuit 106 are represented by the input f(t). The input f(t) includes disturbances associated with changes in bit rpm such as torsional vibration including stick slip, whirl, etc.

Figure 4:
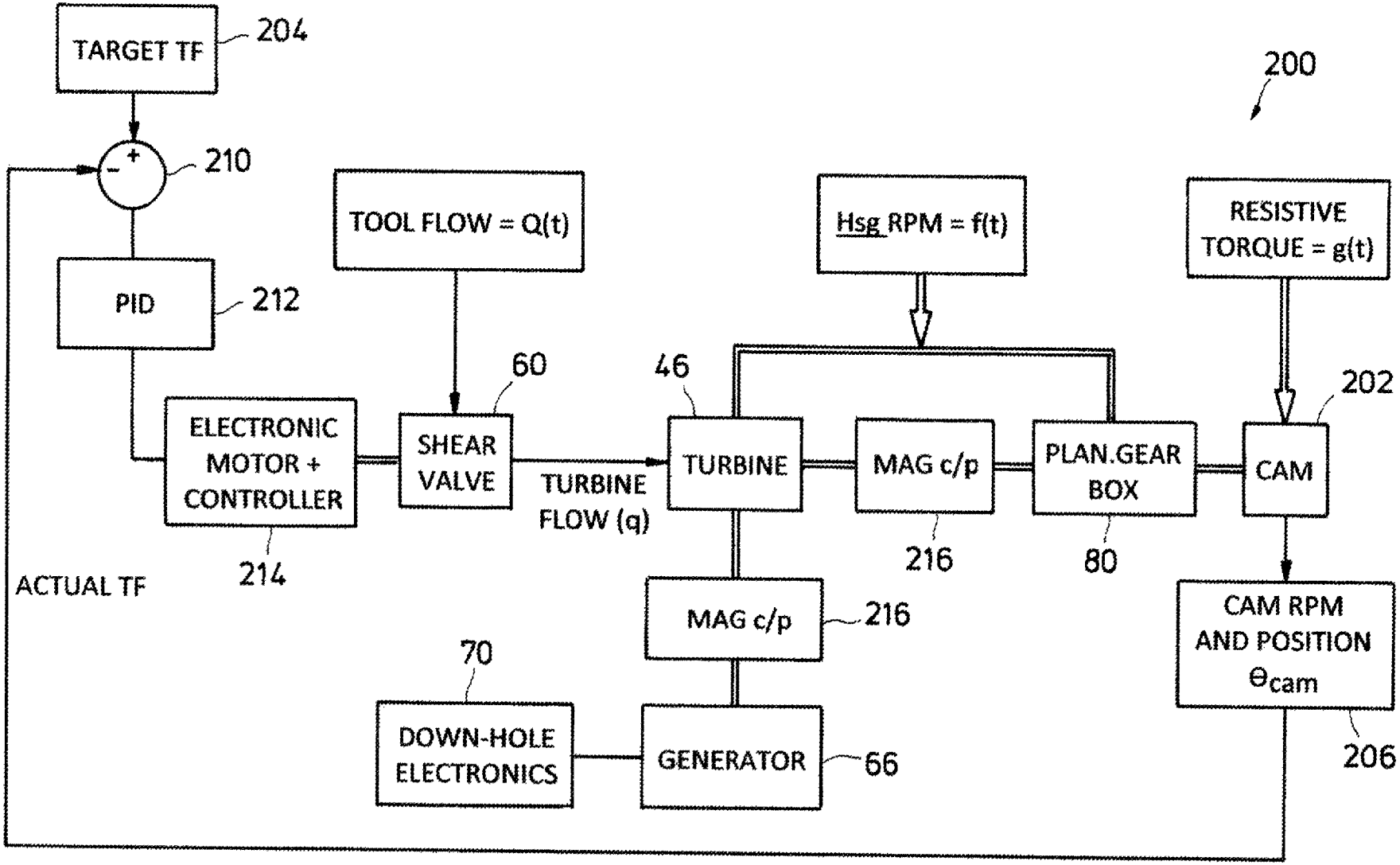
FIG. 4 is a schematic block diagram of a of FIG. 1 a down-hole power generation system in accordance with some alternate exemplary embodiments of the disclosure.

Referring to FIG. 4, a down-hole power generation system 200 includes a cam 202 mechanically coupled to the turbine 46 via the gear box 80 and driven by the turbine 46 through the gear box 80. The cam 202 may receive the rotational motion through the gear box 80 at a rotational speed $\omega_2$ that is different from the rotational speed $\omega_1$ at which the generator 66 receives rotational motion from the turbine 66. In some exemplary embodiments, the cam 220 is operably coupled to the rotary drill bit 14 (FIG. 1) and may define a tool face of the BHA 32 or an orientation of the BHA 32 (FIG. 1) with respect to a fixed reference.

The power generation system 200 operates the cam 202 in a manner that permits a predetermined target tool face to be approximated. The predetermined target tool face "Target TF" is input into the power generation system 200 from an input module 204. In some exemplary embodiments, the input module 204 includes a non-transitory memory with the target tool face pre-programmed thereon and/or a communication device or telemetry unit to which the target tool face may be transmitted, e.g., from an operator at the surface location "S" or from another down-hole component. The power generation system 200 also includes a feedback device 206 for determining an actual tool face "Actual TF" achieved by the cam 202. In some exemplary embodiments, the feedback device 206 includes down-hole sensors such as accelerometers, magnetometers, or other devices electrically or operably coupled to the cam 202, or otherwise arranged to detect, measure, or otherwise determine an orientation of the cam 202.

In some exemplary embodiments, the feedback device 206 is also operable to detect and measure the rotational speed $\omega_2$ of the cam 202. The rotational speed $\omega_2$ of the cam 202 may be influenced by a resistive torque g(t), which may include external forces such as frictional forces imparted by the geologic formation "G" and internal forces such as friction between moving components such as bearings, seals, viscous fluids, etc. The rotational speed $\omega_2$ of the cam 202 may also be influenced by the input forces f(t) imparted to the turbine 46 and the gear box 80. The resistive torque g(t) and the input forces f(t) may be inconsistent over time and may be difficult to estimate or predict. The feedback device 206 may monitor the rotational speed $\omega_2$ of the cam 202, and thus account for this unpredictability.

The input device 204 and the feedback device 206 are operably coupled to a comparator 210. The comparator 210 is operable to receive the target tool face "Target TF" from the input device 204 and the actual tool face "Actual TF" from the feedback 206, and to determine an error or difference between the target tool face "Target TF" and the actual tool face "Actual TF." The comparator 210 is in operative communication with a data processing unit 212, and is operable to transmit the error or difference thereto.

The data processing unit 212 is operable to receive the error or difference from the comparator 210 and to evaluate the error or difference between the target tool face "Target TF" and the actual tool face "Actual TF." Based on the error evaluation, the data processing unit 212 is operable to generate instructions to cause the power generation system 200 to maintain operational characteristics thereof, or to adjust operational characteristics thereof as necessary to more closely approximate the target tool face "Target TF." In some exemplary embodiments, the data processing unit 212 comprises a proportional-integral-derivative (PID) controller. As one skilled in the art will appreciate, a PID controller may provide instructions to attempt to minimize the error evaluated. In particular, the data processing unit 212 may provide instructions to a motor controller of the motor assembly 214, which may in turn provide instructions to an electric motor of the motor assembly 214 to cause the motor to operate the shear valve 60. As described above, the shear valve 60 controls the proportion of the tool flow Q(t) that is directed to the turbine 46 as turbine flow q(t), and thereby controls the rotational speed $\omega_1$ of the turbine 46 and the rotational speed $\omega_2$ of the cam 202. Since the actual tool face "Actual TF" may be related to the rotational speed $\omega_2$ of the cam, the data processing 212 may thus instruct the power generation system to 200 to approximate the target tool face "Target TF."

As illustrated in FIG. 4, the comparator 210 may be separate or distinct from the data processing unit 212. In other embodiments, a data processing unit 212 may be provided that has an integrated comparator 210 therein. For example, a data processing unit 212 may include both a comparator 210 and a PID controller therein.

In some embodiments, the feedback device 206 is operable to measure a second rotational speed $\omega_2$ and provide the second rotational speed $\omega_2$ to the data processing unit 212. The data processing unit 212 can include instructions thereon for minimizing an error between the measured second rotational speed $\omega_2$ and a target second rotational speed provided to the data processing unit 212 from the input module 204. In some exemplary embodiments, the first and second rotational speeds $\omega_1$, $\omega_2$ are similar to one another, and in some exemplary embodiments, the first and second rotational speeds $\omega_1$, $\omega_2$ are different from one another.

In some exemplary embodiments, the generator 66 and the gear box 80 are each coupled to the turbine 46 by a respective magnetic coupling 216. As one skilled in the art will appreciate, magnetic couplings 216 permit the transmission of torque therethrough without physical contact between the turbine shaft 54 (FIG. 2) and the couplings 216. Magnetic couplings 216 generally require less maintenance than physical couplings and permit a greater degree of misalignment between the turbine 46 and the components coupled thereto, e.g., the generator 66 and the gear box 80.

2. Example Implementation

Figure 5:
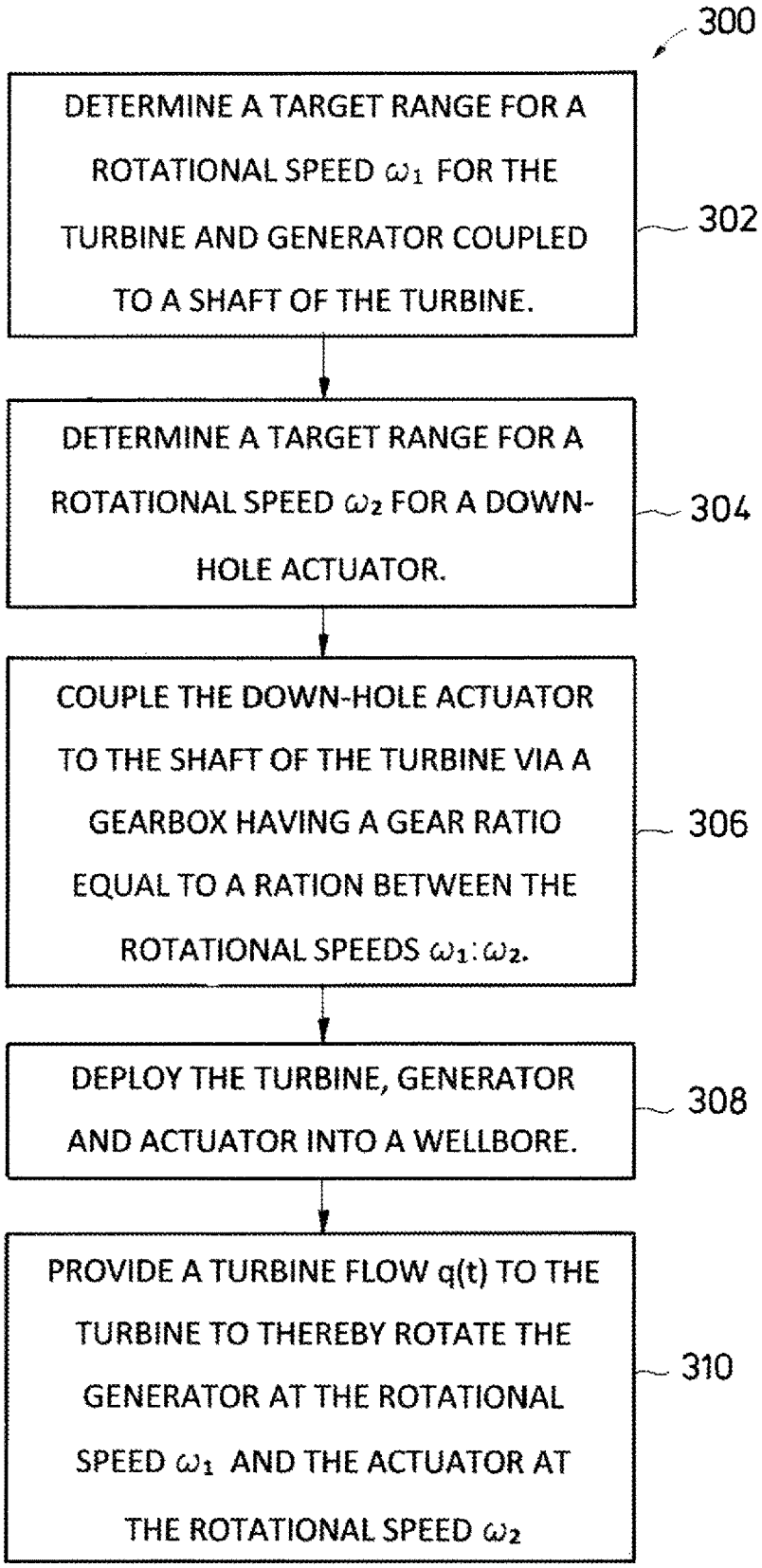
FIG. 5 is a flowchart illustrating operational procedures employing the down-hole power generation systems of FIGS. 3 and 4.

Referring now to FIG. 5, and with reference to FIGS. 2 and 3, exemplary embodiments of an operational procedure 300 are described that employ a power generation system such as power generation systems 100, 200 described above. Initially at step 302, a target range is determined for a rotational speed $\omega_1$ for the turbine 46 and the generator 66 coupled thereto. In some exemplary embodiments, the target range for the rotational speed $\omega_1$ can include determining the power requirements of the down-hole electronics 70 and selecting the target rotational speed $\omega_1$ range that will ensure sufficient power is provided by the generator 66. At step 304, a target range is determined for a rotational speed $\omega_2$ for a down-hole actuator 78. In exemplary embodiments, the down-hole actuator 78 may be any device, structural member or other component operably coupled to the turbine shaft 54 (FIG. 2) to receive rotational motion from the turbine shaft 54 in response to rotation of the turbine shaft 54. In some embodiments, determining the target range for the rotational speed $\omega_2$ can include determining or estimating internal forces f(t) and external resistive torque g(t) (FIG. 4) for a particular down-hole operation, and selecting the target rotational speed $\omega_2$ based at least partially on the determination. In some other embodiments, determining the target range for the rotational speed $\omega_2$ can include assessing the operational speed limitations of the actuator 78, and selecting the target rotational speed $\omega_2$ to be within the operational speed limitations of the actuator 78. In some exemplary embodiments, a target rotational speed $\omega_1$ may be about 2000 RPM and a target rotational speed $\omega_2$ may be about 100 RPM.

Next, at step 306, the down-hole actuator 78 is coupled to the turbine 46 through gearbox 80 having a gear ratio for producing the target rotational speeds $\omega_1$, $\omega_2$ in the generator 66 and actuator 78, respectively, upon operation of the turbine 46. For example, a gearbox 80 may be selected having a gear ratio of 21 to produce the rotational speed $\omega_1$ of about 2000 RPM in the generator 66 and the target rotational speed $\omega_2$ of about 100 RPM in the actuator 78 upon rotation operation of the turbine 46 at the rotational speed $\omega_1$ of about 2000 RPM.

The turbine 46, generator 66 and actuator 78 may then be deployed in a wellbore 12 (FIG. 1). e.g., on a drill string 18 at step 308. Once in the wellbore 12, at step 310 the turbine flow q(t) can then be provided to the turbine 46 to thereby operate the turbine 46 and the generator 66 at the rotational speed $\omega_1$ and the actuator 78 at the rotational speed $\omega_2$. By coupling the generator 66 and the actuator 78 having disparate target rotational speeds to the same turbine shaft 54, the BHA 32 may exhibit a decreased axial length at lower capital costs. This arrangement precludes the need for separate turbines to drive the generator 66 and actuator 78.

3. Aspects of the Disclosure

In one aspect, the disclosure is directed to a down-hole power generation system including a turbine responsive to the circulation of drilling fluid therethrough to generate rotational motion in a turbine shaft thereof. The down-hole power generation system also includes a generator operable to produce an electrical voltage in response to rotation of a generator shaft thereof. The generator shaft is operably coupled to the turbine shaft to rotate at a first rotational speed in response to rotation of the turbine shaft. An actuator is operably coupled to the turbine shaft to receive rotational motion from the turbine shaft in response to rotation of the turbine shaft. A gearbox is operably coupled between the generator shaft and the actuator such the actuator receives rotational motion from the turbine shaft at a second rotational speed.

In some exemplary embodiments, the second rotational speed is different from the first rotational speed, and in some exemplary embodiments, the gearbox includes a planetary gear system. In one or more exemplary embodiments, the down-hole power generation system further comprises a down-hole tool operably coupled to the actuator, and the down-hole tool may include at least one of a rotary drill bit, a hydraulic pump, a cutting tool, a vibratory tool, and a valve mechanism. In some embodiments, the gearbox is coupled to the turbine shaft by a magnetic coupling.

In one or more exemplary embodiments, the generator shaft is directly coupled to turbine shaft such that the generator shaft is induced to rotate at the first rotational speed by rotation of the turbine shaft at the first rotational speed. The down-hole power generation system may further include a fluid control mechanism fluidly coupled to the turbine and operable to regulate a flow of the drilling fluid through the turbine, and thereby control the first rotational speed of the turbine shaft and the generator shaft. In some exemplary embodiments, the generator is operably coupled to the fluid control mechanism such that the electrical voltage facilitates operation of the fluid control mechanism.

In another aspect, the disclosure is directed to a bottom hole assembly including turbine responsive to the circulation of drilling fluid therethrough to generate rotational motion in a turbine shaft thereof and a generator operable to produce an electrical voltage in response to rotation of a generator shaft thereof. The generator shaft is operably coupled to the turbine shaft to rotate at a first rotational speed in response to rotation of the turbine shaft. A rotary drill bit is operably coupled to the turbine shaft to receive rotational motion from the turbine shaft in response to rotation of the turbine shaft, and a gearbox is operably coupled between the generator shaft and the rotary drill bit such the rotary drill bit receives rotational motion from the turbine shaft at a second rotational speed.

In one or more exemplary embodiments, the second rotational speed is different from the first rotational speed. In some exemplary embodiments, the generator shaft and the gearbox are coupled to the turbine shaft by magnetic couplings. In some embodiments, the generator shaft is coupled to the turbine shaft such that the generator shaft operates at the first rotational speed in response to rotation of the turbine shaft at the first rotational speed. In some exemplary embodiments, the bottom hole assembly further includes down-hole electronics electrically coupled to the generator and responsive the electrical voltage, and the down-hole electronics may be operable to adjust the first rotational speed of the turbine shaft and the generator shaft. In some exemplary embodiments, the bottom hole assembly further includes a feedback device operable of detecting and measuring the second rotational speed.

According to another aspect of the disclosure, a method of forming and operating a down-hole power supply, includes (a) determining a target first rotational speed for an electrical generator coupled to a down-hole turbine shaft, (b) determining a target second rotational speed for a down-hole actuator, and (c) coupling the down-hole actuator to the turbine shaft by a gearbox having a gear ratio to produce the target first rotational speed in the electrical generator and the target second rotational speed in the actuator upon rotation of the turbine shaft.

In some exemplary embodiments, the method further includes providing a flow of drilling fluid through the turbine to thereby rotate the turbine shaft. In one or more exemplary embodiments, the method further includes measuring a rotational speed of the down-hole actuator generated in response to providing the flow of drilling fluid through the turbine. In one or more exemplary embodiments, the method further includes adjusting the flow of drilling fluid through the turbine to thereby adjust the rotational speed of the down-hole actuator in response to measuring the rotational speed of the down-hole actuator.

In one or more exemplary embodiments, the method further includes operatively coupling a rotary drill bit to the down-hole actuator. In some embodiments, the method further includes rotating the turbine shaft to thereby rotate the generator at the target first rotational speed and to thereby rotate the rotary drill bit at the target second rotational speed.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A down-hole power generation system, comprising:

a drill string extending into a wellbore defining a longitudinal axis;

a turbine coupled in the drill string and responsive to the circulation of drilling fluid therethrough to generate rotational motion in a turbine shaft thereof;

a generator operable to produce an electrical voltage in response to rotation of a generator shaft thereof, the generator shaft operably coupled to the turbine shaft to rotate at a first rotational speed in response to rotation of the turbine shaft;

an actuator operably coupled to the turbine shaft to receive rotational motion from the turbine shaft in response to rotation of the turbine shaft to thereby define a rotational orientation of the down-hole power generation system about the longitudinal axis to define a direction of drilling; and a gearbox operably coupled between the generator shaft and the actuator such the actuator receives rotational motion from the turbine shaft at a second rotational speed.

2. The down-hole power generation system of claim 1, wherein the second rotational speed is different from the first rotational speed.

3. The down-hole power generation system of claim 1, wherein the gearbox comprises a planetary gear system.

4. The down-hole power generation system of claim 1, wherein the gearbox is coupled to the turbine shaft by a magnetic coupling.

5. The down-hole power generation system of claim 1, wherein the generator shaft is directly coupled to turbine shaft such that the generator shaft is induced to rotate at the first rotational speed by rotation of the turbine shaft at the first rotational speed.

6. The down-hole power generation system of claim 5, further comprising a fluid control mechanism fluidly coupled to the turbine and operable to regulate a flow of the drilling fluid through the turbine, and thereby control the first rotational speed of the turbine shaft and the generator shaft.

7. The down-hole power generation system of claim 6, wherein the generator is operably coupled to the fluid control mechanism such that the electrical voltage facilitates operation of the fluid control mechanism.

8. A bottom hole assembly for connection in a drill string extending along a longitudinal axis, the bottom hole assembly comprising:

a turbine responsive to the circulation of drilling fluid therethrough to generate rotational motion in a turbine shaft thereof;

a generator operable to produce an electrical voltage in response to rotation of a generator shaft thereof, the generator shaft operably coupled to the turbine shaft to rotate at a first rotational speed in response to rotation of the turbine shaft;

an actuator operably coupled to the turbine shaft to receive rotational motion from the turbine shaft in response to rotation of the turbine shaft to thereby define a rotational orientation of the bottom hole assembly with respect to the longitudinal axis;

a gearbox operably coupled between the generator shaft and the actuator such the actuator receives rotational motion from the turbine shaft at a second rotational speed that is different from the first rotational speed; and a rotary drill bit operably coupled to the turbine shaft to receive rotational motion from the turbine shaft in response to rotation of the turbine shaft.

9. The bottom hole assembly of claim 8, wherein the second rotational speed is different from the first rotational speed.

10. The bottom hole assembly of claim 8, wherein the generator shaft and the gearbox are coupled to the turbine shaft by magnetic couplings.

11. The bottom hole assembly of claim 10, wherein the generator shaft is coupled to the turbine shaft such that the generator shaft operates at the first rotational speed in response to rotation of the turbine shaft at the first rotational speed.

12. The bottom hole assembly of claim 11, further comprising down-hole electronics electrically coupled to the generator and responsive the electrical voltage, and wherein the down-hole electronics are operable to adjust the first rotational speed of the turbine shaft and the generator shaft.

13. The bottom hole assembly of claim 12, further comprising a feedback device operable of detecting and measuring the second rotational speed.

14. A method of forming and operating a down-hole power supply in a wellbore defining a longitudinal axis, the method comprising:

determining a target first rotational speed for an electrical generator coupled to a down-hole turbine shaft;

determining a target second rotational speed for a down-hole actuator operable to define a rotational orientation of the down-hole power supply about the longitudinal axis; and coupling the down-hole actuator to the turbine shaft by a gearbox having a gear ratio to produce the target first rotational speed in the electrical generator and the target second rotational speed in the actuator upon rotation of the turbine shaft.

15. The method of claim 14, further comprising providing a flow of drilling fluid through the turbine to thereby rotate the turbine shaft.

16. The method of claim 15, further comprising measuring a rotational speed of the down-hole actuator generated in response to providing the flow of drilling fluid through the turbine.

17. The method of claim 16, further comprising adjusting the flow of drilling fluid through the turbine to thereby adjust the rotational speed of the down-hole actuator in response to measuring the rotational speed of the down-hole actuator.

18. The method of claim 14, further comprising operatively coupling a rotary drill bit to the down-hole actuator.

19. The method of claim 18, further comprising rotating the turbine shaft to thereby rotate the generator at the target first rotational speed and to thereby rotate the rotary drill bit at the target second rotational speed.

* * * * *